US006619270B2

(12) United States Patent
Yomogida

(10) Patent No.: US 6,619,270 B2
(45) Date of Patent: Sep. 16, 2003

(54) ENGINE FUEL INJECTION CONTROL DEVICE

(75) Inventor: Koichiro Yomogida, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 73 days.

(21) Appl. No.: 09/964,106

(22) Filed: Sep. 25, 2001

(65) Prior Publication Data

US 2002/0011238 A1 Jan. 31, 2002

(51) Int. Cl.[7] ..... F02M 51/00; F02D 41/06

(52) U.S. Cl. ..... 123/491; 123/478; 123/436; 701/104

(58) Field of Search ..... 123/491, 435, 123/436, 453, 456, 472, 478, 480, 490, 492, 493, 497; 701/104, 105, 110, 113; 239/585.1

(56) References Cited

U.S. PATENT DOCUMENTS

| | | | | | |
|---|---|---|---|---|---|
| 4,463,731 | A | * | 8/1984 | Matsuoka | 123/492 |
| 4,508,084 | A | * | 4/1985 | Yamato et al. | 123/492 |
| 4,765,301 | A | * | 8/1988 | Koike et al. | 123/491 |
| 4,987,871 | A | * | 1/1991 | Nishikawa | 123/362 |
| 5,596,968 | A | * | 1/1997 | Ueda et al. | 123/480 |
| 5,722,365 | A | * | 3/1998 | Sadakane et al. | 123/336 |
| 5,809,969 | A | * | 9/1998 | Fiaschetti et al. | 123/436 |
| 6,257,207 | B1 | * | 7/2001 | Inui et al. | 123/491 |

FOREIGN PATENT DOCUMENTS

| | | | | |
|---|---|---|---|---|
| JP | 58-204941 | | 11/1983 | F02D/5/00 |
| JP | 186939 | * | 8/1988 | F02D/41/06 |
| JP | 370343 | * | 12/1992 | F02D/41/16 |
| JP | 11-006459 | | 1/1999 | F02D/41/38 |
| JP | 263131 | * | 9/2001 | F02D/41/06 |

* cited by examiner

*Primary Examiner*—Hieu T. Vo
*Assistant Examiner*—Hai Huynh
(74) *Attorney, Agent, or Firm*—McCormick, Paulding & Huber LLP

(57) ABSTRACT

An engine fuel injection control device for improving stability of engine rotation after startup by determining a limited fuel injection amount for cold condition when the engine is insufficiently warmed-up, in addition to a limited fuel injection amount for normal operating condition. The limited fuel injection amount for normal operating condition Qlimo is calculated by a normal condition limited fuel injection amount calculating unit (42). The limited fuel injection amount for cold condition Qlimc is calculated by a cold condition limited fuel injection amount calculating unit (43) on the basis of engine rotational speed Ne. When a water temperature Tw is lower than a prescribed value Twd and a lapse time Trun after shifting from startup condition to normal operating condition is less than a prescribed time Trund, a limited fuel injection amount selecting unit (45) selects the larger of these values as a limited fuel injection amount Qlim.

20 Claims, 3 Drawing Sheets

ENGINE FUEL INJECTION CONTROL DEVICE

CROSS REFERENCE TO RELATED APPLICATION

This application corresponds to Japanese Patent Application No. 2000-069984 filed in JPO on Mar. 14, 2000, the entire disclosure of which is incorporated herein by reference.

BACKGROUND OF THE INVENTION

1. Field of the Invention

The present invention relates to an engine fuel injection control device that controls the amount of fuel injection in cold running when the engine temperature has not yet risen sufficiently immediately after engine startup.

2. Description of the Related Art

Conventionally, fuel injection control of, for example, a diesel engine performed when the engine is in the startup operating condition is performed with a startup fuel injection amount found as the fuel injection amount which is a maximum for the engine, from the cooling water temperature and/or engine rotational speed. After engine startup, the target fuel injection amount is determined by using a map which is previously found from the engine rotational speed and amount of depression of the accelerator pedal. For example, when the condition of the engine shifts to the idling operating condition in which there is scarcely any accelerator pedal depression immediately after engine startup, this map is determined such that the target fuel injection amount increases as the engine rotational speed falls, in the low range of engine rotational speed. Therefore, fuel injection amount control is performed under feedback control such that engine rotational speed is constant.

A diesel engine fuel injection control device in which the maximum value of fuel injection amount is made variable in response to an external air pressure is disclosed in, for example, Japanese Patent Application Laid-Open Publication No. 58-204941. With the fuel injection control device disclosed in this publication, in order to cope with the fuel injection amount becoming excessive relative to the air intake amount when the atmosphere becomes thin during running at high altitudes, prevention of combustion deterioration is aimed at by detecting the external air pressure, inputting the detected external air pressure signal to a control circuit that controls the maximum load of the fuel injection pump and automatically controlling the fuel injection amount in accordance with the reduced oxygen amount in the air intake amount.

A fuel injection control device which aims to guarantee vehicle running characteristics and guarantee engine startup characteristics even when there is an abrupt change in the air intake amount or the detected value of the air intake amount falls below the normal value is disclosed in Japanese Patent Application Laid-Open Publication No. 11-6459. With this fuel injection control device, a maximum injection amount calculated from the air intake amount is employed under normal condition, and an allowed maximum injection amount is employed in the vicinity of maximum supercharging. In this manner, it is aimed at to stabilize the fuel injection even if the air intake amount changes abruptly and to enable minimum engine operation even if there is abnormality of the air intake amount detection means by setting a maximum injection amount as small as possible.

In an ordinary diesel engine, the engine is insufficiently warmed-up immediately after startup is carried out when the engine is cold, so there is an unstable condition of engine rotation in which there are large fluctuations of speed. However, with constitution of a conventional fuel injection control device, the fuel injection amount is calculated at time of startup, and rapid startup is performed by using this fuel injection amount at startup. On the contrary, after startup, a mode shifts to an ordinary mode, so that immediately after startup, the fuel injection amount cannot be sufficiently increased, causing the engine to stall or to take some time to settle down in a stable condition.

A problem to be solved is therefore how to achieve early stabilization of engine rotational speed when it is concluded that the engine operating condition is cold condition, that is the engine has not yet warmed up sufficiently.

SUMMARY OF THE INVENTION

With the foregoing in view, an object of the present invention is to provide an engine fuel injection control device whereby stabilization can be achieved at an early stage by raising the engine rotational speed by determining the limited fuel injection amount a little on the high side if the engine is not fully warmed up. This limited fuel injection amount is carried out by a calculation other than a calculation in the ordinary engine operating condition.

In order to achieve the above object, one embodiment of the present invention is constructed as follows. Specifically, there is provided an engine fuel injection control device including basic fuel injection amount calculation means for calculating a basic fuel injection amount in accordance with engine operating condition, limited fuel injection amount calculation means for calculating a limited fuel injection amount in accordance with the engine operating condition, and target fuel injection amount determining means for comparing the basic fuel injection amount with the limited fuel injection amount and for determining the smaller of these as a target fuel injection amount. The limited fuel injection amount calculation means includes a normal condition limited fuel injection amount calculating unit that calculates a limited fuel injection amount for normal condition in accordance with the engine operating condition on the assumption that the engine is in normal operating condition, a cold condition limited fuel injection amount calculating unit that calculates a limited fuel injection amount for cold condition on the assumption that the engine is in cold operating condition, and a limited fuel injection amount selecting unit that selects, as the above-mentioned limited fuel injection amount, the larger of the limited fuel injection amount for normal condition and the limited fuel injection amount for cold condition, in response to the water temperature of the engine being lower than a prescribed temperature and in response to the lapse time after changeover of the engine from startup operating condition to normal operating condition being shorter than a prescribed time.

With this engine fuel injection control device, the normal condition fuel injection amount calculating unit calculates a limited fuel injection amount for normal condition on the assumption that the engine operating condition is normal operating condition, and the cold condition limited fuel injection amount calculating unit calculates a limited fuel injection amount for cold condition on the assumption that the engine operating condition is cold operating condition. The limited fuel injection amount selecting unit selects, as a limited fuel injection amount, the larger of the limited fuel injection amount for normal condition and the limited fuel injection amount for cold condition, in response to the engine water temperature being lower than a prescribed temperature and the lapse time after changeover of the engine from startup operating condition to normal operating condition being shorter than a prescribed time. That is, if the engine water temperature is lower than a prescribed temperature and the lapse time after changeover of the engine from startup operating condition to normal operating condition is shorter than a prescribed time, it is concluded that the engine has not yet sufficiently warmed-up, so that the larger of the limited fuel injection amount for normal condition and limited fuel injection amount for cold condition is selected as the limited fuel injection amount. The target fuel injection amount determining means compares the basic fuel injection amount calculated in accordance with engine operating condition and the limited fuel injection amount selected as described above, and determines the target fuel injection amount as the smaller of these. That is, the limited fuel injection amount is limited by the basic fuel injection amount.

The normal condition limited fuel injection amount calculating unit calculates a limited fuel injection amount for normal condition in accordance with the engine rotational speed and the atmospheric pressure The cold condition limited fuel injection amount calculating unit calculates a limited fuel injection amount for cold condition in accordance solely with the engine rotational speed. Taking into account not only engine rotational speed but also the lowered atmospheric pressure when the vehicle on which the engine is mounted is started up at a high altitude, the limited fuel injection amount for normal condition calculated by the normal condition limited fuel injection amount calculating unit in response to the lowered oxygen content in the intake air is less than the limited fuel injection amount for cold condition calculated by the cold condition limited fuel injection amount calculating unit solely in response to the engine rotational speed. Consequently, the stability of engine rotation after startup at high altitudes is improved because the limited fuel injection amount selecting unit selects, as the limited fuel injection amount, the limited fuel injection amount for cold condition which has a larger value than the limited fuel injection amount for normal condition.

The limited fuel injection amount for cold condition may be set as a value that is always larger than the limited fuel injection amount for normal condition.

The limited fuel injection amount selecting unit may select the limited fuel injection amount for normal condition as the limited fuel injection amount, in response to the water temperature of the engine being more than a prescribed temperature or the lapse time being more than a prescribed time.

Preferably, the basic fuel injection amount calculating means calculates the basic fuel injection amount in accordance with the rotational speed of the engine and the operating amount of the accelerator.

Preferably the engine fuel injection control device of the present invention is applied to a diesel engine.

The diesel engine may be a common rail type diesel engine including a high-pressure supply pump, a common rail that accumulates fuel supplied under pressure from this high-pressure supply pump, an injector that injects fuel supplied from the common rail into the combustion chamber of the engine when an electromagnetic actuator is driven, and a controller that applies control current to the electromagnetic actuator for driving the electromagnetic actuator for a prescribed time in a prescribed period.

According to one aspect of the present invention, there is provided an engine fuel injection control device including, a basic fuel injection amount calculation device that calculates the basic fuel injection amount in accordance with engine operating condition, a limited fuel injection amount calculation device that calculates a limited fuel injection amount in accordance with the engine operating condition, and a target fuel injection amount determining device that compares the basic fuel injection amount with the limited fuel injection amount and that determines the smaller of these as a target fuel injection amount. The limited fuel injection amount calculation device includes a normal condition limited fuel injection amount calculating unit that calculates a limited fuel injection amount for normal condition in accordance with the engine operating condition on the assumption that the engine is in normal operating condition, a cold condition limited fuel injection amount calculating unit that calculates a limited fuel injection amount for cold condition on the assumption that the engine is in cold operating condition, and a limited fuel injection amount selecting unit that selects, as the above-mentioned limited fuel injection amount, the larger of the limited fuel injection amount for normal condition and the limited fuel injection amount for cold condition in response to the water temperature of the engine being lower than a prescribed temperature and the lapse time after changeover of the engine from startup operating condition to normal operating condition being shorter than a prescribed time.

Preferably, the normal condition limited fuel injection amount calculating unit calculates the limited fuel injection amount for normal condition in accordance with the rotational speed of the engine and atmospheric pressure, and the cold condition limited fuel injection amount calculating unit calculates the limited fuel injection amount for cold condition in accordance solely with the rotational speed of the engine.

Preferably, the limited fuel injection amount for cold condition is always set as a value larger than the limited fuel injection amount for normal condition.

Preferably, the limited fuel injection amount selecting unit selects the limited fuel injection amount for normal condition as the limited fuel injection amount in response to the water temperature of the engine being more than a prescribed temperature or the lapse time being more than a prescribed time.

Preferably, the basic fuel injection amount calculating device calculates the basic fuel injection amount in accordance with the rotational speed of the engine and the operating amount of the accelerator.

According to another aspect of the present invention, there is provided an engine fuel injection control method including a basic fuel injection amount calculation step of calculating the basic fuel injection amount in accordance with engine operating condition, a limited fuel injection amount calculation step of calculating a limited fuel injection amount in accordance with the engine operating condition, and a target fuel injection amount determining step of comparing the basic fuel injection amount with the limited fuel injection amount and of determining the smaller of these as a target fuel injection amount. The limited fuel injection amount calculation step includes a normal condition limited fuel injection amount calculating step of calculating a limited fuel injection amount for normal condition in accordance with the engine operating condition on the assumption that the engine is in normal operating condition, a cold condition limited fuel injection amount calculating step of calculating a limited fuel injection amount for cold condition on the assumption that the engine is in cold operating condition, and a limited fuel injection amount selection step of selecting, as the above-mentioned limited fuel injection amount, the larger of the limited fuel injection amount for normal condition and the limited fuel injection amount for cold condition, in response to the water temperature of the engine being lower than a prescribed temperature and the lapse time after changeover of the engine from startup operating condition to normal operating condition being shorter than a prescribed time.

Preferably, in the normal condition limited fuel injection amount calculating step, the limited fuel injection amount for normal condition is calculated in accordance with the rotational speed of the engine and atmospheric pressure, and in the cold condition limited fuel injection amount calculating step, the limited fuel injection amount for cold condition is calculated in accordance solely with the rotational speed of the engine.

Preferably, the limited fuel injection amount for cold condition is always set as a value larger than the limited fuel injection amount for normal condition.

Preferably, in the limited fuel injection amount selection step, the limited fuel injection amount for normal condition is selected as the limited fuel injection amount in response to the water temperature of the engine being more than a prescribed temperature or the lapse time being more than a prescribed time.

Preferably, the engine fuel injection control method of the present invention is applied to a diesel engine.

The diesel engine may be a common rail type diesel engine comprising a high-pressure supply pump, a common rail that accumulates fuel supplied under pressure from this high-pressure supply pump, an injector that injects fuel supplied from the common rail into the combustion chamber of the engine when an electromagnetic actuator is driven, and a controller that applies control current to the electromagnetic actuator for driving this electromagnetic actuator for a prescribed time in a prescribed period.

DETAILED DESCRIPTION OF THE INVENTION

An embodiment of an engine fuel injection control device according to the present invention is described below with reference to the appended drawings.

Figure 3:
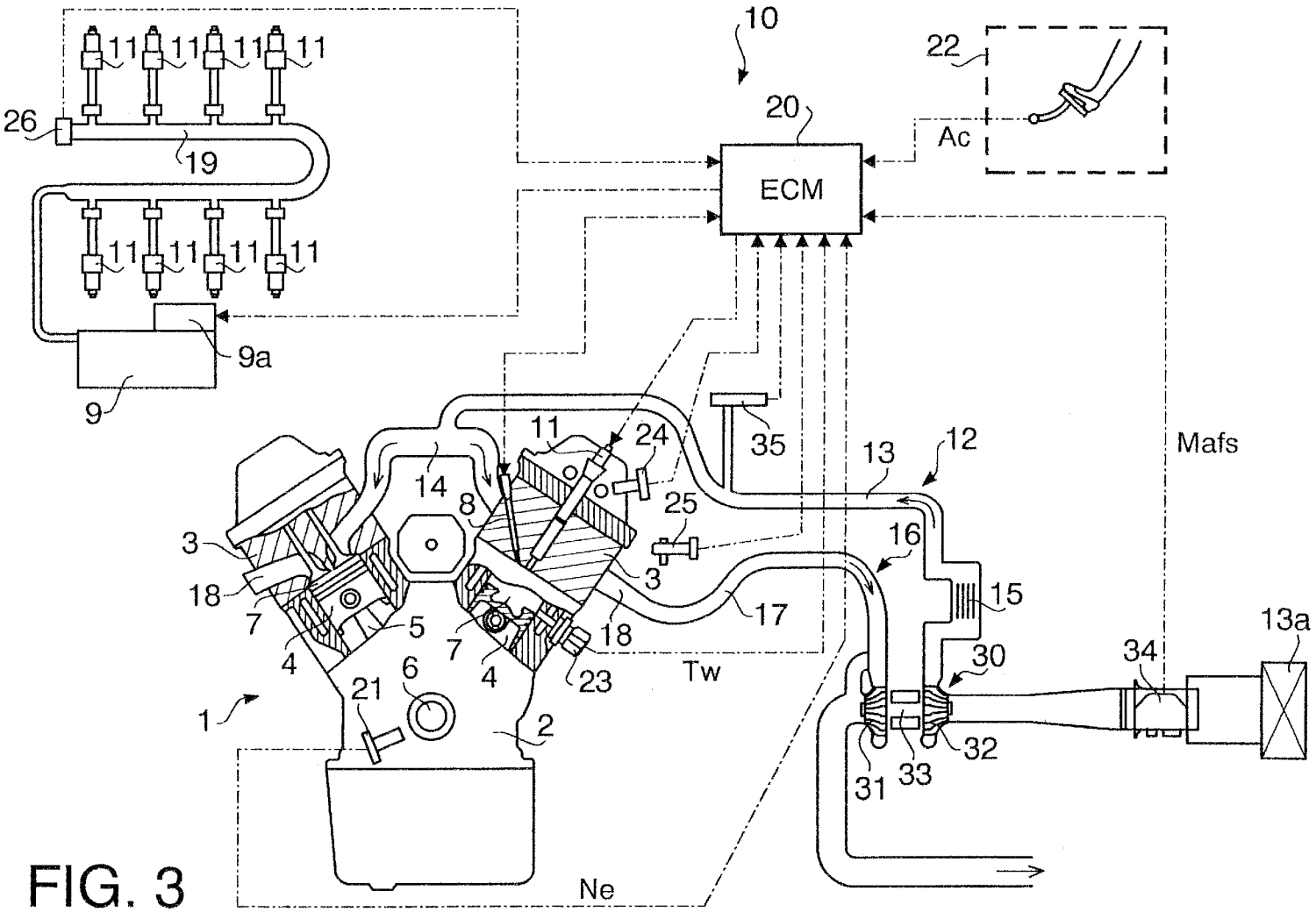
FIG. 3 is a diagram showing an example of an engine to which a fuel injection control device of FIG. 1 is applied.

An engine 1 having a supercharger shown in FIG. 3 is a V type six-cylinder engine to which a fuel injection control device according to the present invention is applied. The engine 1 includes a cylinder block 2 forming cylinder bores and cylinder heads 3 mounted on the cylinder block 2. Reciprocatory movement of pistons 4 which are freely slidable within cylinder liners mounted in the cylinder bores is converted to rotary movement of a crank shaft 6 by means of a connecting rod 5.

In an electronically controlled fuel injection system 10 of the engine 1, working fluid constituted by fuel or engine oil supplied under pressure from a high-pressure supply pump 9 provided in the fuel supply system is accumulated on a common rail 19 and supplied from the common rail 19 to injectors 11. A plurality of injectors 11 (the number of the injectors is 6 in the example illustrated) corresponding to the number of cylinders are provided in cylinder heads 3 and constitutes a unitary combination of an injector body that performs fuel injection and an electromagnetic actuator for controlling fuel injection from a nozzle and for stopping injection. The injectors 11 are operated by working fluid from the common rail 19 and inject fuel directly into fuel chambers 7 with a fuel injection pressure that is raised to a value corresponding to the operating condition of the engine. The electronic control fuel injection system 10 has a controller 20 constituting an electronic control unit (ECU). The controller 20 receives detection signals from sensors that detect the operating condition of the engine 1, and the controller 20 thereby controls the pressure (rail pressure) in the common rail 19 by controlling the electromagnetic actuators provided in the injectors 11 in accordance with these detected signals and by controlling a flow amount control valve 9*a* provided in high-pressure supply pump 9. Preheating of the interior of the combustion chamber on a low-temperature start is performed by a glow plug 8.

A crank angle sensor 21 for detecting the rotational speed Ne of the engine 1 is constituted by an electromagnetic pickup that detects a gearwheel formed with a missing tooth that is fixed to the crankshaft 6 and that rotates together with the crankshaft. An optical sensor or other suitable sensor could be employed. In addition to the detection signal from the crank angle sensor 21, controller 20 receives detection signals from an accelerator operating amount sensor 22 that detects the accelerator operating amount (amount of depression of the accelerator pedal) Ac, a water temperature sensor 23 that detects the water temperature Tw of cooling water circulating through the cylinder block 2 (or an oil temperature sensor that detects the lubricating oil temperature), a cam sensor 24 provided in the cylinder head 3 for detecting the shaft rotation angle of a cam that operates a suction and exhaust valve, an atmospheric pressure sensor 25, and a pressure sensor 26 arranged on the common rail 19, etc.

The injection time point and injection amount with which fuel is injected from the injectors 11 are controlled by controlling the current passage time point and current passage period of the control current to the electromagnetic injectors from the controller 20. The controller 20 controls the fuel injection amount by determining the current passage period (pulse width) to the electromagnetic actuators in accordance with a target fuel injection amount which is a target value found from the operating condition of the engine, and by driving the electromagnetic actuators in accordance with this pulse width. The crank angle detected by the crank angle sensor 21, together with the detection signals of the various sensors that detect arrival of the piston at the top dead center of compression or at a position at a prescribed angle in advance of the compression top dead center in the reference cylinder or in each cylinder is used to control the current passage start time point and current passage period of the drive current that drives the electromagnetic actuators.

In an air intake system 12 to the engine 1, an air intake pipe 13 by which air from outside is admitted through an air cleaner 13*a* is connected to the engine 1 through an intake manifold 14. The intake manifold 14 is connected to the combustion chamber 7 through an intake valve (not shown). In order to improve the filling efficiency, an inter-cooler 15 is provided for cooling the intake air into air intake pipe 13.

An exhaust system 16 for exhausting exhaust gas from the engine 1 to outside includes an exhaust manifold 18 that communicates with the combustion chamber 7 through an exhaust valve (not shown), and an exhaust pipe 17 that is connected to the engine 1 through the exhaust manifold 18. Although not shown, an exhaust gas cleaning device and an energy recovery device for recovering energy contained in the exhaust gas are arranged on the exhaust pipe 17.

A supercharger 30 including a variable nozzle turbine is arranged between the air intake system 12 and the exhaust system 16. The supercharger 30 has a turbine 31 arranged on the side of the exhaust system 16 and whose turbine blades are driven by high-temperature exhaust gas, a compressor 32 arranged on the side of the air intake system 12 for compressing the intake air. The compressor 32 is driven by the turbine 31. The supercharger also has a shaft 33 that connects the turbine 31 and the compressor 32.

A mass airflow sensor 34 constituting air intake amount detection means arranged on the upstream side of the supercharger 30 for detecting the amount of air passing therethrough is provided in the air intake pipe 13. The mass airflow sensor 34 may be the air weight detection type or the air volume detection type (in this case, an intake air temperature sensor may be provided for detecting the temperature of the intake air, and the air weight is calculated from the air volume and intake air temperature). A boost pressure sensor 35 for detecting the intake air pressure is disposed on the downstream side of the supercharger 30 in air intake pipe 13. A signal in respect of the air intake amount detected by the mass airflow sensor 34 and a signal in respect of the air intake pressure detected by the boost pressure sensor 35 are respectively input to the controller 20.

Figure 1:
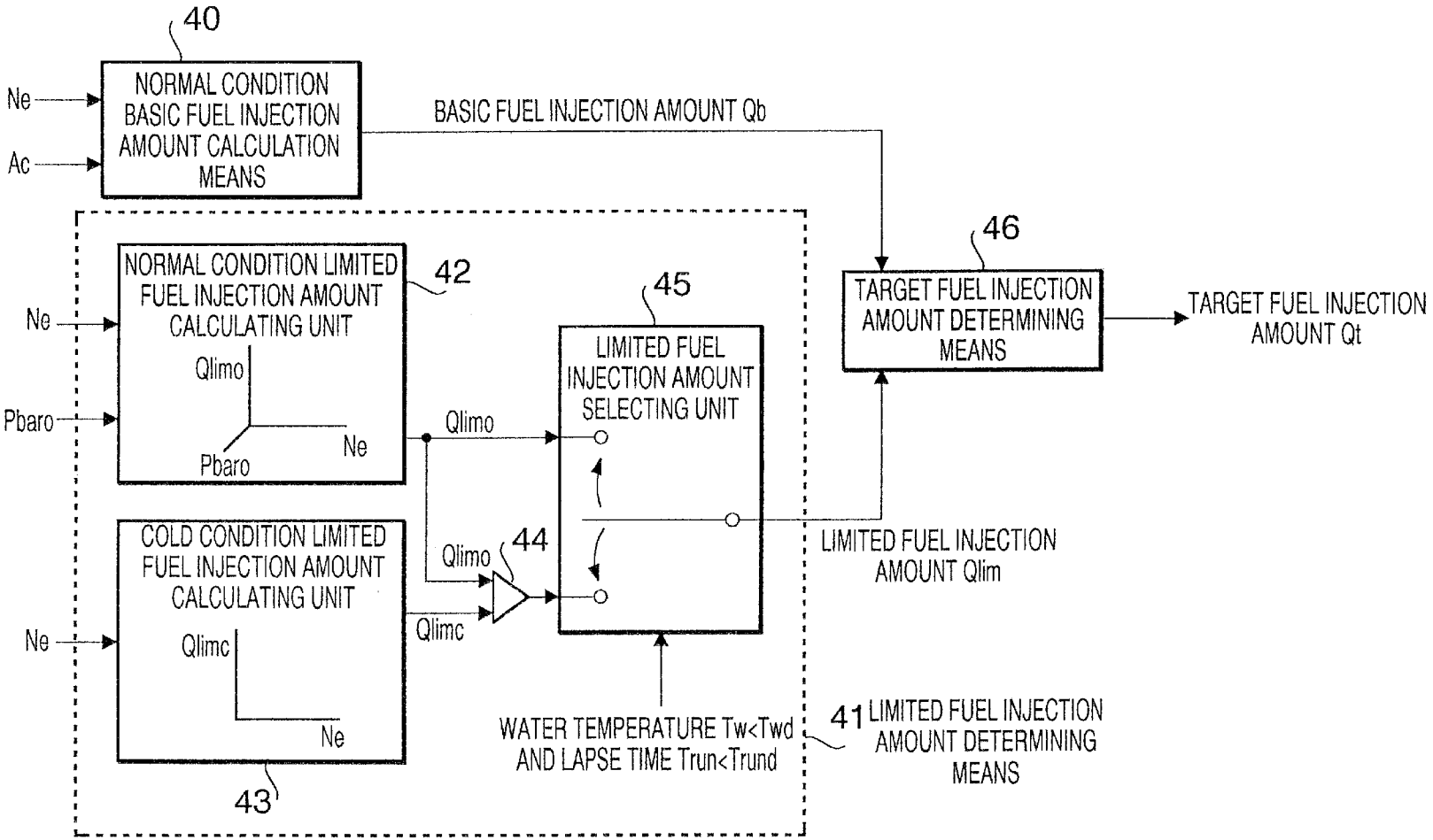
FIG. 1 is a block diagram illustrating an embodiment of an engine fuel injection control device according to the present invention.

An embodiment of an engine fuel injection control device according to the present invention is described with reference to the block diagram shown in FIG. 1. Normal condition basic fuel injection amount calculation means 40 calculates the basic fuel injection amount Qb constituting the basic fuel injection amount when the engine operating condition is the normal operating condition, based on the accelerator operating amount Ac such as the accelerator pedal depression amount and engine rotational speed Ne. On the other hand, a normal condition limited fuel injection amount calculating unit 42 calculates the limited fuel injection amount for normal condition Qlimo constituting the upper limit of a fuel injection amount under normal condition, based on engine operating condition such as engine rotational speed Ne and/or atmospheric pressure Pbaro detected by an atmospheric pressure sensor 25 etc. Furthermore, a the cold condition limited fuel injection amount calculating unit 43 calculates the limited fuel injection amount for cold condition Qlimc as an upper limit of the injection amount with which fuel can be injected. Qlimc is calculated based on the current engine rotational speed Ne, on the assumption that the engine is in cold operating condition. A comparator 44 compares the limited fuel injection amount for normal condition Qlimo calculated by the normal condition limited fuel injection amount calculating unit 42 with the limited fuel injection amount for cold condition Qlimc calculated by the cold condition limited fuel injection amount calculating unit 43, and selects and outputs the larger of these values.

A limited fuel injection amount selecting unit 45 receives limited fuel injection amount for normal condition Qlimo calculated by the normal condition limited fuel injection amount calculating unit 42, receives the output of the comparator 44, and selects, as the limited fuel injection amount Qlim, either the limited fuel injection amount for normal condition Qlimo or limited fuel injection amount for cold condition Qlimc, depending on the water temperature Tw and the lapse time Trun after changeover of the engine operating condition from the startup condition to the normal operating condition. Specifically, so long as the water temperature Tw does not exceed the prescribed temperature Twd and the lapse time Trun after the engine has changed over from the startup condition to the normal operating condition does not exceed the prescribed time Trund, the limited fuel injection amount selecting unit 45 determines the larger of the limited fuel injection amount for normal condition Qlimo and the limited fuel injection amount for cold condition Qlimc as the limited fuel injection amount Qlim. The normal condition limited fuel injection amount calculating unit 42, the cold condition limited fuel injection amount calculating unit 43, the comparator 44 and the limited fuel injection amount selecting unit 45 constitute limited fuel injection amount determining means 41 (limited fuel injection amount calculation means 41) in the embodiment of the present invention. Target fuel injection amount determining means 46 compares the basic fuel injection amount Qb calculated by the normal condition basic fuel injection amount calculation means 40 with the limited fuel injection amount Qlim determined by the limited fuel injection amount determining means 41, and determines the smaller of these values as a target fuel injection amount Qt.

Figure 2:
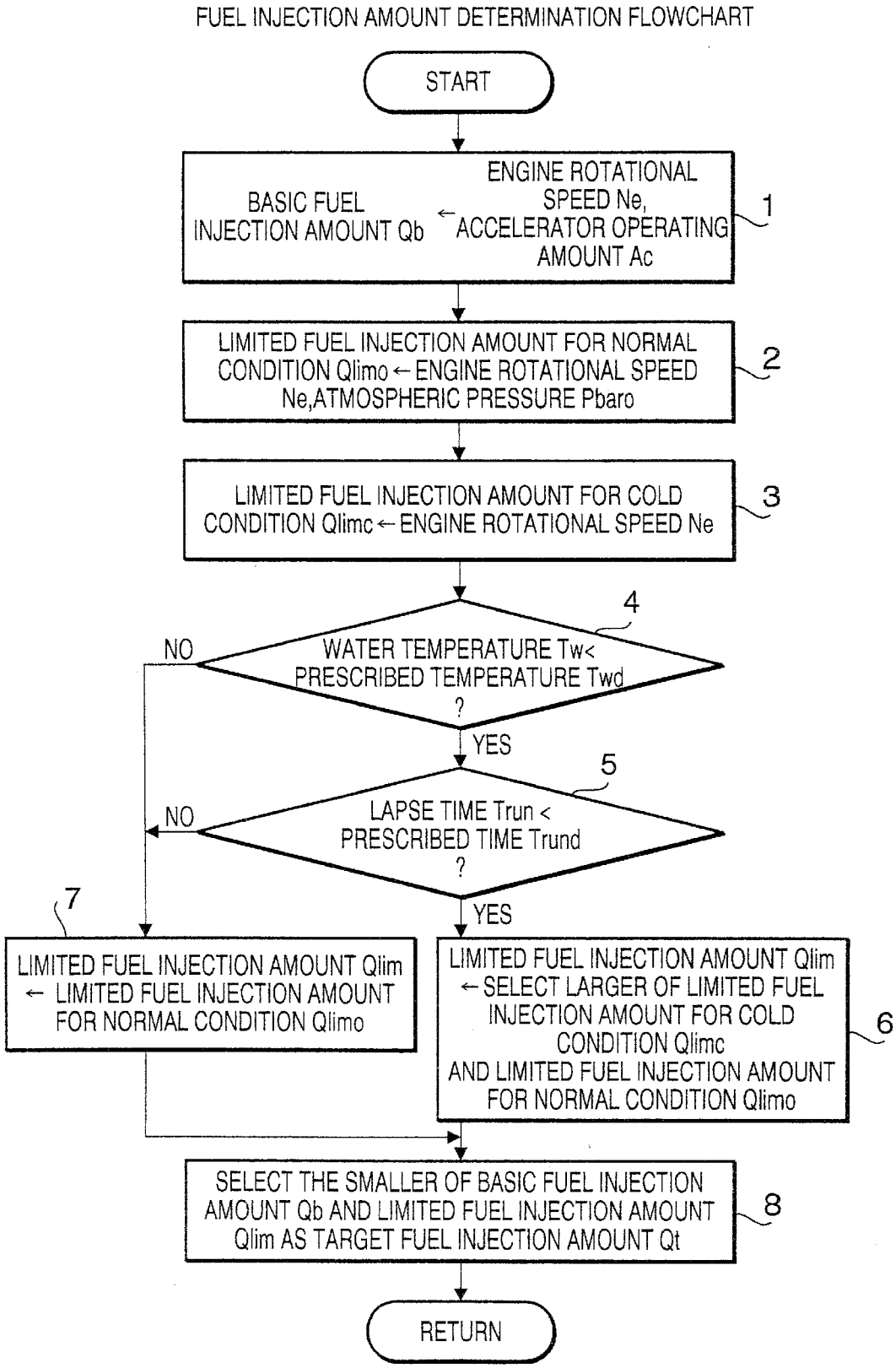
FIG. 2 is a flow chart of determination of a target fuel injection amount in an engine fuel injection control device as shown in FIG. 1.

Next, the embodiment of the operation of the engine fuel injection control device according to the present invention will be described with reference to the flowchart shown in FIG. 2. The normal condition basic fuel injection amount calculation means 40 (FIG. 1) calculates the basic fuel injection amount Qb (step 1) based on engine operating condition i.e. engine rotational speed Ne and accelerator operating amount Ac such as the accelerator depression amount. The normal condition limited fuel injection amount calculating unit 42 (FIG. 1) calculates (step 2) the limited fuel injection amount for normal condition Qlimo based on the engine rotational speed Ne and the atmospheric pressure Pbaro detected by the atmospheric pressure sensor 25. The cold condition limited fuel injection amount calculating unit 43 calculates (step 3) the limited fuel injection amount for cold condition Qlimc in accordance with the engine rotational speed Ne. The fuel injection control device ascertains (step 4) whether or not the water temperature Tw for engine cooling is lower than the prescribed temperature Twd. If the water temperature Tw is at or above the prescribed temperature Twd, flow branches to step 7. In addition, if the water temperature Tw is lower than the prescribed temperature Twd, the fuel injection control device ascertains whether or not the lapse time Trun after the engine has changed over from the startup condition to the normal operating condition is less than the prescribed time Trund (step 5). If the lapse time Trun exceeds the prescribed time Trund, flow branches to step 7.

If the water temperature Tw is lower than the prescribed temperature Twd and in addition the lapse time Trun after the engine has been changed over from the startup condition to the ordinary operating condition is less than the prescribed time Trund, it is concluded that the engine is immediately after startup and so has not been sufficiently warmed-up, so that the larger of the limited fuel injection amount for cold condition Qlimc calculated by the cold condition limited fuel injection amount calculating unit 43 and the limited fuel injection amount for normal condition Qlimo is selected as the limited fuel injection amount Qlim (step 6). At this point, if the limited fuel injection amount for cold condition Qlimc is always set larger than the limited fuel injection amount for normal condition Qlimo, it would also be possible for the limited fuel injection amount for cold condition Qlimc to be selected unconditionally. That is, if the vehicle in which the engine 1 (FIG. 3) is mounted is started up at high altitude, the limited fuel injection amount for normal condition Qlimo calculated by the normal condition limited fuel injection amount calculating unit 42 is calculated in accordance with the reduced oxygen content in the air intake amount by taking into account not just the rotational speed Ne of the engine but also the lowered atmospheric pressure. The limited fuel injection amount for normal condition Qlimc is calculated by the cold condition limited fuel injection amount calculating unit 43, exclusively in accordance with the engine rotational speed Ne. Therefore, Qlimo can be set to be always less than the limited fuel injection amount for cold condition Qlimc. In this case, the limited fuel injection amount for cold condition Qlimc whose value is larger than that of the limited fuel injection amount for normal condition Qlimo is selected as the limited fuel injection amount Qlim by the limited fuel injection amount selecting unit 45 and is input to the target fuel injection amount determination means 46.

If the flow branches as a result of a decision taken in step 4 or step 5, the limited fuel injection amount for normal condition Qlimo calculated by the normal condition limited fuel injection amount calculating unit 42 (FIG. 1) based on the engine rotational speed Ne and the atmospheric pressure Pbaro detected by the atmospheric pressure sensor 25 is taken as the limited fuel injection amount Qlim (step 7). The smaller of the basic fuel injection amount Qb found in step 1 and the limited fuel injection amount Qlim selected in step 4 or 5 is determined as the target fuel injection amount Qt (step 8). That is, the limited fuel injection amount Qlim selected at the limited fuel injection amount for cold condition which is larger value during cold condition when the engine temperature is low is used to restrict the upper limit of the basic fuel injection amount Qb.

With the engine fuel injection control device constructed as above according to the present invention, the larger of two fuel injection amounts whose calculation details are altered in the normal case and in the case of cold condition such as immediately after startup is selected by the limited fuel injection amount determining means. Therefore, even under cold condition immediately after engine startup when the engine is not sufficiently warmed up, the fuel injection amount can be determined a little on the high side by setting of the upper limit as a value larger than the value to which it is limited in ordinary operating condition as the limited fuel injection amount. Consequently, the engine operating condition can be rapidly shifted to a stable operating condition with the engine rotational speed being rising rapidly and with small fluctuation of the rotational speed. Also, since the calculation of the limited fuel injection amount for cold condition is determined solely by the engine rotational speed rather than a calculation performed by inputting a plurality of items of information, the calculation of limited fuel injection amount can be performed in a short time, enabling a rapid shift of the engine condition to stable condition.

What is claimed is:

1. An engine fuel injection control device comprising:

basic fuel injection amount calculation means for calculating a basic fuel injection amount in accordance with engine operating condition;

limited fuel injection amount calculation means for calculating a limited fuel injection amount in accordance with the engine operating condition; and target fuel injection amount determining means for comparing said basic fuel injection amount with said limited fuel injection amount and for determining the smaller of these amounts as a target fuel injection amount;

wherein said limited fuel injection amount calculation means includes:

a normal condition limited fuel injection amount calculating unit that calculates a limited fuel injection amount for normal condition in accordance with the engine operating condition, on the assumption that the engine is in normal operating condition;

a cold condition limited fuel injection amount calculating unit that calculates a limited fuel injection amount for cold condition, on the assumption that the engine is in cold operating condition; and a limited fuel injection amount selecting unit that selects, as said limited fuel injection amount, the larger of said limited fuel injection amount for normal condition and said limited fuel injection amount for cold condition, in response to a water temperature of the engine being lower than a prescribed temperature and a lapse time after changeover of the engine from startup operating condition to normal operating condition being shorter than a prescribed time.

2. The engine fuel injection control device according to claim 1, wherein said normal condition limited fuel injection amount calculating unit calculates said limited fuel injection amount for normal condition in accordance with a rotational speed of the engine and an atmospheric pressure, and said cold condition limited fuel injection amount calculating unit calculates said limited fuel injection amount for cold condition, in accordance solely with the rotational speed of the engine.

3. The engine fuel injection control device according to claim 1, wherein said limited fuel injection amount for cold condition is always set as a value larger than said limited fuel injection amount for normal condition.

4. The engine fuel injection control device according to claim 1, wherein said limited fuel injection amount selecting unit selects said limited fuel injection amount for normal condition as said limited fuel injection amount in response to the water temperature of the engine being more than a prescribed temperature or said lapse time being more than a prescribed time.

5. The engine fuel injection control device according to claim 1, wherein said basic fuel injection amount calculating means calculates said basic fuel injection amount in accordance with the rotational speed of the engine and an operating amount of an accelerator.

6. The engine fuel injection control device according to claim 1, wherein the engine fuel injection control device is applied to a diesel engine.

7. The engine fuel injection control device according to claim 6, wherein said diesel engine includes a high-pressure supply pump, a common rail that accumulates fuel supplied under pressure from the high-pressure supply pump, an injector that rejects fuel supplied from the common rail into a combustion chamber of the engine when an electromagnetic actuator is driven, and a controller that applies control current to the electromagnetic actuator for driving the electromagnetic actuator for a prescribed time in a prescribed period.

8. An engine fuel injection control device comprising:

a basic fuel injection amount calculation device that calculates a basic fuel injection amount in accordance with engine operating condition;

a limited fuel injection amount calculation device that calculates a limited fuel injection amount in accordance with the engine operating condition; and a target fuel injection amount determining device that compares said basic fuel injection amount with said limited fuel injection amount and that determines the smaller of these amounts as a target fuel injection amount;

wherein said limited fuel injection amount calculation device includes:

a normal condition limited fuel injection amount calculating unit that calculates a limited fuel injection amount for normal condition, in accordance with the engine operating condition, on the assumption that the engine is in normal operating condition;

a cold condition limited fuel injection amount calculating unit that calculates a limited fuel injection amount for cold condition, on the assumption that the engine is in cold operating condition; and a limited fuel injection amount selecting unit that selects, as said limited fuel injection amount, the larger of said limited fuel injection amount for normal condition and said limited fuel injection amount for cold condition, in response to a water temperature of the engine being lower than a prescribed temperature and a lapse time after changeover of the engine from startup operating condition to normal operating condition being shorter than a prescribed time.

9. The engine fuel injection control device according to claim 8, wherein said normal condition limited fuel injection amount calculating unit calculates said limited fuel injection amount for normal condition in accordance with a rotational speed of the engine and an atmospheric pressure, and said cold condition limited fuel injection amount calculating unit calculates said limited fuel injection amount for cold condition in accordance solely with the rotational speed of the engine.

10. The engine fuel injection control device according to claim 8, wherein said limited fuel injection amount for cold condition is always set as a value larger than said limited fuel injection amount for normal condition.

11. The engine fuel injection control device according to claim 8, wherein said limited fuel injection amount selecting unit selects said limited fuel injection amount for normal condition as said limited fuel injection amount, in response to the water temperature of the engine being more than a prescribed temperature or said lapse time being more than a prescribed time.

12. The engine fuel injection control device according to claim 8, wherein said basic fuel injection amount calculating device calculates said basic fuel injection amount in accordance with a rotational speed of the engine and an operating amount of an accelerator.

13. The engine fuel injection control device according to claim 8, wherein the engine fuel injection control device is applied to a diesel engine.

14. The engine fuel injection control device according claim 13, wherein said diesel engine includes a high-pressure supply pump, a common rail that accumulates fuel supplied under pressure from the high-pressure supply pump, an injector that injects fuel supplied from the common rail into a combustion chamber of the engine when an electromagnetic actuator is driven, and a controller that applies control current to the electromagnetic actuator for driving the electromagnetic actuator for a prescribed time in a prescribed period.

15. An engine fuel injection control method comprising:

the basic fuel injection amount calculation step of calculating a basic fuel injection amount in accordance with engine operating condition;

the limited fuel injection amount calculation step of calculating a limited fuel injection amount in accordance with the engine operating condition; and the target fuel injection amount determining step of comparing said basic fuel injection amount with said limited fuel injection amount and of determining the smaller of these amounts as a target fuel injection amount;

wherein said limited fuel injection amount calculation step includes:

the normal condition limited fuel injection amount calculating step of calculating a limited fuel injection amount for normal condition, in accordance with the engine operating condition, on the assumption that the engine is in normal operating condition;

the cold condition limited fuel injection amount calculating step of calculating a limited fuel injection amount for cold condition, on the assumption that the engine is in cold operating condition; and the limited fuel injection amount selection step of selecting, as said limited fuel injection amount, the larger of said limited fuel injection amount for normal condition and said limited fuel injection amount for cold condition, in response to a water temperature of the engine being lower than a prescribed temperature and a lapse time after changeover of the engine from startup operating condition to normal operating condition being shorter than a prescribed time.

16. The engine fuel injection control method according to claim 15, wherein in said normal condition limited fuel injection amount calculating step, said limited fuel injection amount for normal condition is calculated in accordance with a rotational speed of the engine and an atmospheric pressure, and in said cold condition limited fuel injection amount calculating step, said limited fuel injection amount for cold condition is calculated in accordance solely with the rotational speed of the engine.

17. The engine fuel injection control method according to claim 15, wherein said limited fuel injection amount for cold condition is always set as a value larger than said limited fuel injection amount for normal condition.

18. The engine fuel injection control method according to claim 15, wherein in said limited fuel injection amount selection step, said limited fuel injection amount for normal condition is selected as said limited fuel injection amount, in response to the water temperature of the engine being more than a prescribed temperature or the lapse time being more than a prescribed time.

19. The engine fuel injection control method according to claim 15, wherein said method is applied to a diesel engine.

20. The engine fuel injection control method according to claim 19, wherein said diesel engine includes a high-pressure supply pump, a common rail that accumulates fuel supplied under pressure from the high-pressure supply pump, an injector that injects fuel supplied from the common rail into a combustion chamber of the engine when an electromagnetic actuator is driven, and a controller that applies control current to the electromagnetic actuator for driving the electromagnetic actuator for a prescribed time in a prescribed period.

* * * * *